US005826273A

United States Patent [19]

Eckes

[11] Patent Number: 5,826,273

[45] Date of Patent: Oct. 27, 1998

[54] BODY CONFORMING ARTICLE OF CLOTHING HAVING MULTIPLE HEAT POCKETS

[76] Inventor: Mark A. Eckes, 11586 Hwy V, Marshfield, Wis. 54449

[21] Appl. No.: 782,213

[22] Filed: Jan. 13, 1997

[51] Int. Cl.[6] ..... A41D 1/12

[52] U.S. Cl. ..... 2/69; 2/227; 2/115; 2/78.1

[58] Field of Search ..... 2/69, 70, 79, 227, 2/108, 115, 228, 238, 78.1; 607/96, 108, 112, 114; 126/204

[56] References Cited

U.S. PATENT DOCUMENTS

| | | | |
|---|---|---|---|
| 2,403,676 | 7/1946 | Modlinski | 607/108 |
| 2,429,973 | 11/1947 | Alexander . | |
| 2,648,325 | 8/1953 | Siple . | |
| 2,675,798 | 4/1954 | Rosmarin . | |
| 3,476,102 | 11/1969 | Sarnoff . | |
| 4,038,698 | 8/1977 | Smith . | |
| 4,384,369 | 5/1983 | Prince | 2/227 |
| 5,038,779 | 8/1991 | Barry et al. | 607/108 |
| 5,054,127 | 10/1991 | Zevchak | 2/69 |
| 5,269,023 | 12/1993 | Ross . | |
| 5,302,806 | 4/1994 | Simmons et al. | 607/108 |

OTHER PUBLICATIONS

Cabela's 1994–Annual Fall Catalog–pp. 102 & 121; (Thermax Underwear & Bugsweats by Columbia), Sep. 1994.

*Primary Examiner*—Gloria M. Hale

[57] ABSTRACT

An article of clothing for use with a thermal packet for effecting a heat transfer between the packet and the body of a user of the article of clothing that includes a torso enveloping portion conforming to the body of the user. The torso enveloping portion has an upper torso component including arm-receiving portions and a lower torso component including leg-receiving portions. A plurality of pockets are affixed to the exterior of the article of clothing. Each pocket has an inner wall integral with the torso enveloping portion and an outer wall. Each pocket is adapted to receive a thermal packet for effecting a hear transfer between the packet and the body of the user. The inner wall and the outer wall are in direct contact with the thermal packet. The upper torso component and the lower torso component may be separate pieces or joined. The torso enveloping portion is a single layer of fabric, with the fabric having a—[stretchability sufficient to permit the article of clothing to conform to the body of the user, wherein the interior wall of the pocket is in direct contact with the body of the user. The fabric is both a moisture transmitting and a heat transmitting material to promote exchange of moisture from the body through the fabric and transmission of heat from the thermal packet through the fabric to warm the body of the user.

6 Claims, 4 Drawing Sheets

BODY CONFORMING ARTICLE OF CLOTHING HAVING MULTIPLE HEAT POCKETS

TECHNICAL FIELD

This invention relates generally to a body conforming article of clothing having multiple pockets for receiving thermal packets and in particular, to body conforming clothing which is worn under other outer garments and next to the user's body. The invention is particularly well-suited for undergarments and thermal wear such as sweatsuits and ski wear.

BACKGROUND OF THE INVENTION

Sportspersons, ice skaters, skiers, runners, hunters, snowmobilers, snow shoers, all terrain vehicle riders, ice fishermen, as well as persons who must work outdoors, such as construction workers, farmers, postal service employees, police officers, firemen, etc., are exposed to chilling and sometimes frigid weather. It becomes important for the person's comfort, health and enjoyment of the activity to keep their body warm. Adding layer upon layer of additional clothing or using thick, bulky, quilted or padded clothing achieves this goal but with the price of impeding movement of the person. This of course is undesirable as it prevents full enjoyment of the sport or hinders the performance of the work activity.

Some prior art has attempted to respond to some of the problems of warming the body or parts of the body using a means of heating. For example, U.S. Pat. No. 2,429,973 discloses a buoyant life preserver vest of block cork, balsa wood or Kapok with a heat insulating chamber for holding a chemical compound to react with water to produce heat. U.S. Pat. No. 2,648,325 discloses a body warmer sleeveless vest of a stretch resistant material having a series of fluid filled tubes in contact with the wearer's body. Pockets hold a catalytic or chemical heater which warms the fluid in the tubes. The fluid is circulated by movements of the user's body. U.S. Pat. No. 3,476,102 discloses a sleeveless vest type thermal transfer garment of a moisture absorbing material, such as wool or cotton having pockets for carrying thermal change packets. The pocket of the vest or the thermal change packet contains an inflatable bladder. The bladder acts to press the packet against the wearer and also acts as a heat insulator. Alternatively the bladder is replaced with an insulating sheet. The bladder or the sheet are interposed between the packet and an outer wall of the pocket. The vest uses buttons or belts for providing a snug fit about the user's upper body. U.S. Pat. No. 4,038,698 discloses a one-piece rainsuit of a water repellant material having a hood and a face mask for permitting exhaled warm air to be transmitted into the interior of the rainsuit to warm the interior of the rainsuit. U.S. Pat. No. 2,675,798 discloses a replaceable flexible padded heating interlining unit for use in mittens, gloves and leggings. The heat producing means comprises a sealed envelope containing padding and a heat-producing chemical composition. The aforementioned devices are very bulky and are unsuitable for certain sporting or working activities which require ease and full freedom of movement. Further, U.S. Pat. No. 5,269,023 discloses a muff or apron-like device work exterior to the user's clothing. The device is provided with an inner heater pouch that is designed to hold a chemical heat source so as to heat the user's hand, and perhaps the midsection. Again this device may be bulky and awkward, bouncing about with the user's movements, since it is strapped onto the body of the user, thus impeding the activities of the user.

Thus, notwithstanding the many known practical design problems for, the art has not adequately responded to date with the introduction of an article of clothing conforming to the user's body and made of lightweight, flexible, breathable, non-bulky materials with the article of clothing having a plurality of pockets with each pocket capable of receiving a thermal packet.

SUMMARY OF THE INVENTION

The present invention provides an article of clothing for use with a thermal packet for effecting a heat transfer between the packet and the body of a user of the article of clothing. The article of clothing comprises a torso enveloping portion conforming to the body of the user. The torso enveloping portion has an upper torso component and a lower torso component. The upper torso component includes arm-receiving portions. The lower torso component includes leg-receiving portions. A plurality of pockets are affixed to the exterior surface of the article of clothing. Each pocket has an inner wall integral with the torso enveloping portion and an outer wall. Each pocket is adapted to receive a thermal packet for effecting a heat transfer between the packet and the body of the user. The inner wall and the outer wall are in direct contact with the thermal packet. The pockets are disposed upon the upper torso including the arm-receiving portions. The pockets are disposed upon the lower torso including the leg-receiving portions. In one embodiment, the upper torso component and the lower torso component are separate pieces. In another embodiment, the upper torso component and the lower torso component are joined together. The torso enveloping portion is a single layer of fabric, with the fabric having stretchability sufficient to permit the article of clothing to conform to the body of the user, wherein the inner wall of the pocket is in direct contact with the body of the user. The fabric is both a moisture transmitting and a heat transmitting material to promote exchange of moisture from the body through the fabric and transmission of heat from the thermal packet through the fabric to warm the body of the user.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiment of the present invention will hereinafter be described in conjunction with the appended drawing wherein like designations refer to like elements throughout and in which:

FIG. 3 is a rear elevational view of the article of clothing of FIG. 2;

DETAILED DESCRIPTION

Figure 1:
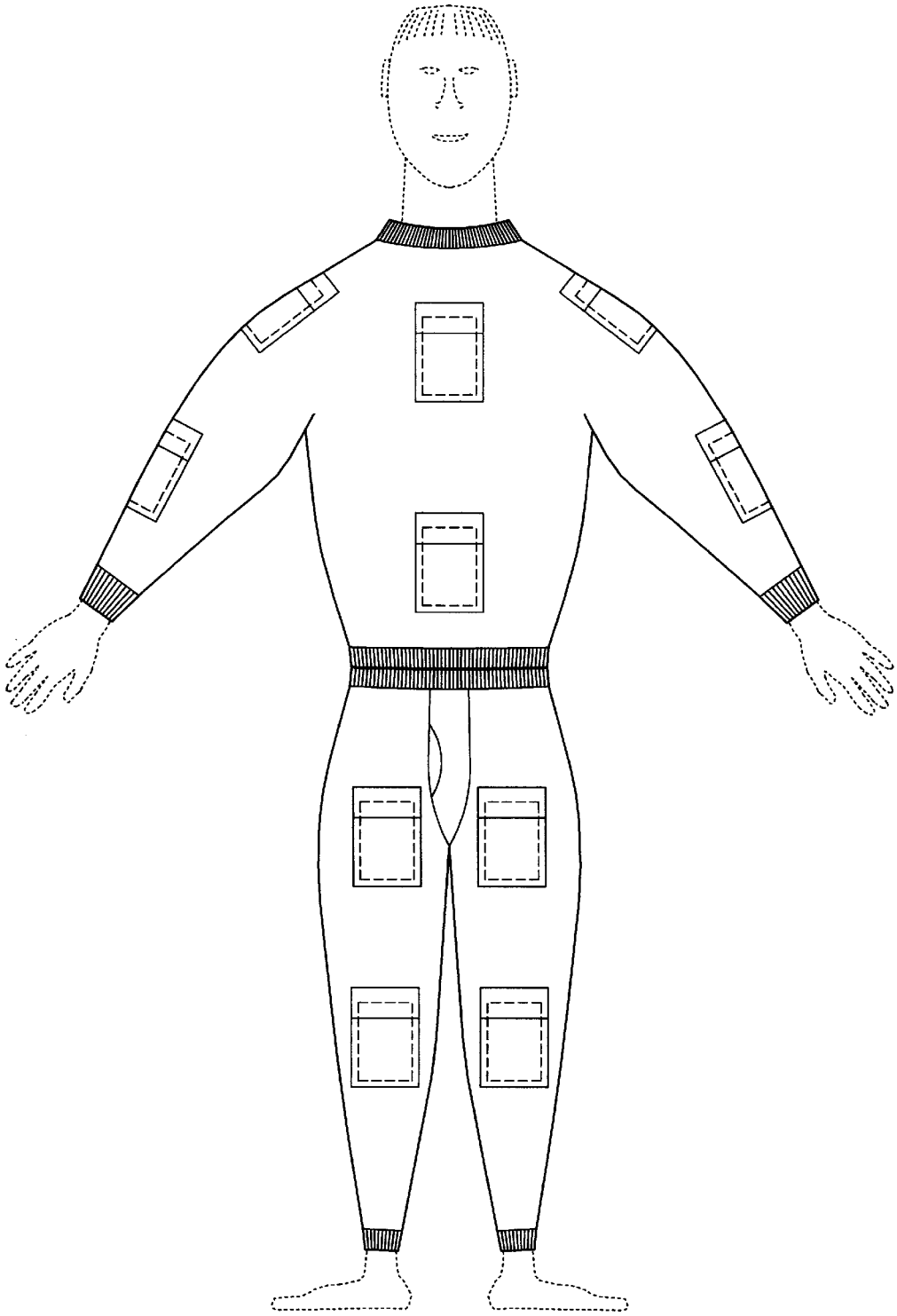
FIG. 1 is a perspective view of the first embodiment of the article of clothing of the present invention, in the form of longjohn thermal underwear, with thermal change producing thermal packets in the pockets of the article of clothing.

The present invention relates broadly to a body conforming article of clothing having multiple pockets for receiving thermal packets and in particular, to body conforming clothing which is worn under other outer garments and next to the user's body. The invention is most particularly well-suited for undergarments and thermal wear such as, sweatsuits, and ski wear, as is best shown in FIGS. 1–6. As will be used in discussing all embodiments of the present invention, by "conforming to the body of the user" is meant that the article of clothing is adjacent to and in contact with portions of the torso, arms and legs of the body of the user, whereby the article of clothing is worn next to the skin of the user or next to the user's underpants or undershirt and/or bra. Also as is used hereinafter, by "thermal packets" is meant heat sources, thermal change producing packets or thermal packets. Additionally, as is used hereinafter by "breathability" is meant that the fabric used in the present invention is able to transmit moisture from the body of the user and will simultaneously transfer heat to the body of the user.

Accordingly, the present invention will now be described in detail with respect to such articles of clothing: however, those skilled in the art will appreciate that such a description of the invention is meant to be exemplary only and should not be viewed as limitative on the full scope thereof.

Reference is initially made to FIGS. 1–3 and 4–6 depicting a first embodiment of a body conforming article of clothing 20 having multiple pockets 22 for receiving heat sources or thermal packets 24, according to the present invention. The article of clothing, specifically thermal long underwear or longjohns 20 comprises a torso enveloping portion 26 conforming to the body 28 of the user 30. The article of clothing has an exterior surface 29 and an interior surface 31. The interior surface 31 is worn next to the skin of the user or the user's underwear, e.g., underpants, undershirt, and/or bra.

The torso enveloping portion 26 has an upper torso component 32 and a lower torso component 34. The upper torso component 32 includes arm-receiving portions 36, 38. The lower torso component 34 includes leg-receiving portions 40, 42. Preferably the article of clothing is constructed as two pieces with the upper torso portion 32 separate from the lower torso portion 34; alternatively the article of clothing 20 is constructed in a unitary fashion as a single piece with the upper torso portion 32 either joined to the lower portion 34 or constructed unitary with the lower torso portion 34.

The upper torso component 32 has a neck ribbing 44 for snugly fitting about the neck 45 of the user 30, sleeve ribbing 46, 48 located on the distal ends of the arm-receiving portions 36, 38 near the user's wrists 50 for snugly fitting about the wrists 50 of the user 30, and an upper torso waist conforming portion 54 for snugly fitting about the waist 52 of the user. The lower torso component 34 has a lower torso waist conforming portion 52 for snugly fitting about the waist 52 of the user and leg ribbing 58, 60 located at the distal ends of the leg-receiving portions 40, 42 for snugly fitting about the ankles 62 of the user 30.

The neck ribbing 44, sleeve ribbing 46, 48 and leg ribbing fabric as is known in the sewing arts, as to provide sufficient stretch to permit the respective body part(s), head 64 and neck 45 for the neck ribbing 44, hand 66 and wrist 50 for the wrist ribbing 46, 48, and foot 68 and ankle 62 for the leg ribbing 58, 60 to enter into the respective appropriate ribbing (44, 46, 48, 58, 60) and to exit from the ribbing portion (44, 46, 48, 58, 60) and permit the respective ribbing portion to snugly fit about the (neck ribbing 44 around) neck 45, (wrist ribbing 46, 48 around) wrists 50, and (leg ribbing 58, 60 around) ankles 62, when the article of clothing 20 is worn by the user 30.

The upper torso waist conforming portion 54 and the lower torso waist conforming portion 52 are made of a sufficiently stretchable fabric to permit the respective upper torso portion and lower torso portion to be pulled over the respective upper torso and lower torso of the user and to have sufficient elasticity to recover to fit snugly upon the waist 52, 54 of the user 30. The waist conforming portions 52, 54 is made of ribbing fabric, or elastic, or drawstring, or others as available on current market as is known in the sewing arts.

Figure 4:
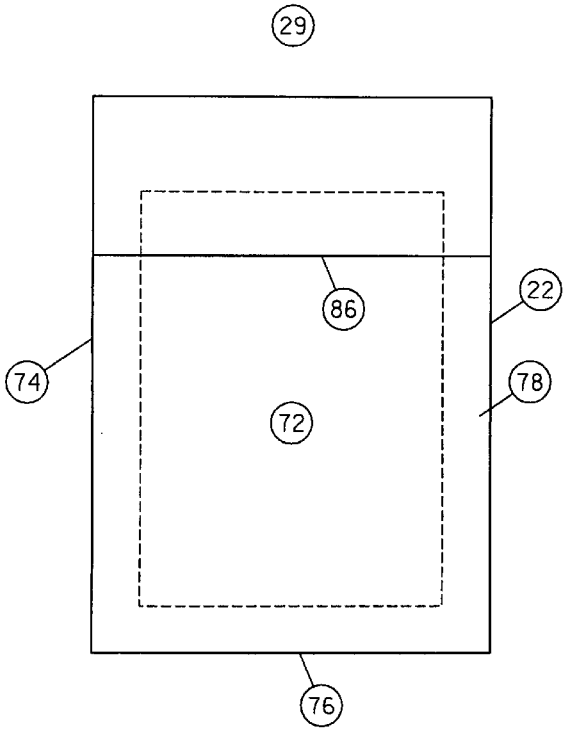
FIG. 4 is a fragmental front view of a typical pocket of the article of clothing of FIG. 1 having a thermal packet therein.
Figure 5:
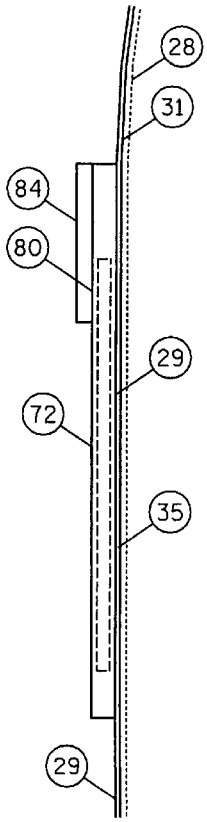
FIG. 5 is a side view of the pocket of FIG. 4, showing the inner wall of the pocket in contact with the skin of the user.
Figure 6:
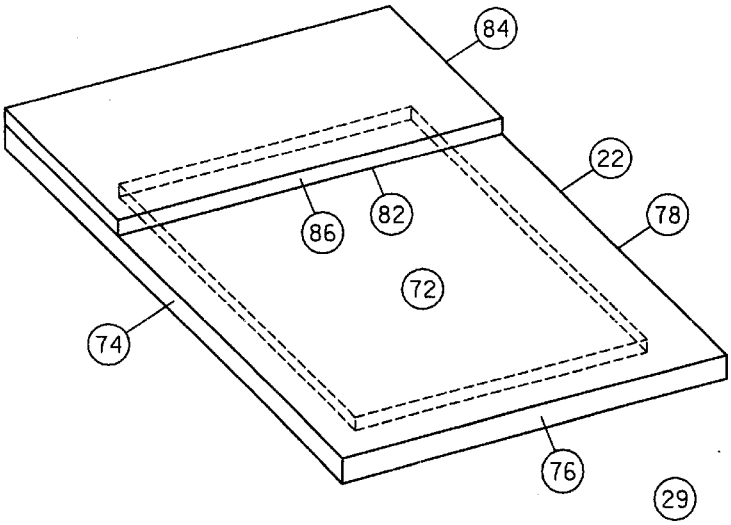
FIG. 6 is a partial perspective view of the pocket of FIG. 4, showing the pocket opening.

A plurality of pockets 22 are affixed to the exterior surface 29 of the article of clothing 20. As best shown in FIG. 4–6, each pocket 22 has an inner wall 29 which is the exterior surface 29 of the torso enveloping portion 26 and an outer wall 72. Each pocket 22 is adapted to receive a thermal packet 24 for effecting a heat transfer between the packet and the body of the user. The inner wall 29 and the outer wall 72 are in direct contact with the thermal packet 24. The pockets 22 are disposed upon the upper torso component 32 including the arm-receiving portions 36, 38. The pockets 22 are also disposed upon the lower torso component 34 including the leg-receiving portions 40, 42. Preferably the pockets are of the "envelope" pocket design. The pocket is designed as the envelope pocket, designed to keep heat source stationary with normal activity.

The preferred pocket style of construction embodied in this invention is described hereinafter. Each pocket 22 is preferably stitched on three sides 74, 76, 78, leaving the fourth side 80 open, thereby creating an opening 82 for inserting the thermal packet 24 into an inside 84 of the pocket 22. The inside 84 of the pocket 22 is located between the inner wall 29 and the outer wall 72. An envelope flap 86 is stitched over portions of sides 74 and 78. Alternatively, as is known in the sewing art, a standard open pocket (a pocket without an envelope flap or closure flap) (not shown) or a pocket with a closure flap over the opening is used (not shown); the pocket may have a button, snap, zipper, Velcro or other fastening means to close the pocket opening 82 or whatever is available on current market, after a thermal packet 24 has been inserted into the inside 84 of the pocket.

The thermal packets 24 are known in the art which create several hours of warming heat. These commercially available thermal packets are reusable or may be of a single use and disposable type. Thermal packets 24 are suitable for use with this invention include but are not limited to, HEATMAX, available from Heatmax, Inc. of Dalton, Ga.; HOT HANDS made by Heatmax, Inc. of Dalton, Ga.; and GRABBER warm packs made by Grabber of Concord, Calif. Typically the GRABBER thermal packet acts as a body warmer providing several hours of continuous heat and is preferably used in the invention.

Alternatively, handwarmers such as the HOT HANDS thermal packet may be used, which provides several hours of continuous heat. The user determines which of the plurality of pockets 22 to fill with the thermal packets 24. Depending upon the physical dimensions of the pocket 22 and the physical dimensions of the thermal packet 24 heat source, one or more thermal packets 24 may be used per pocket 22.

In order to utilize the present invention, the user selects the desired pocket(s) 22 for placement of the thermal packet(s) 24 in the article of clothing 20 and the number of thermal packets 24 to be used. The user activates each thermal packet 24 by carefully following packet manufacturers instructions on the use of the thermal packet and places the thermal packet 24 through the pocket opening 82 and into the inside 84 of the desired pocket 22. After each thermal packet(s) 24 is placed in the desired pocket(s) 22 by the user 30, the user then dons the article of clothing. Successive layers of other outerwear clothing may be worn over the article of clothing 20. Use of the thermal packets are listed on each manufacturers packets, i.e. placed in boots, as hand warmers, under a hat. Packets may be activated as needed.

Figure 2:
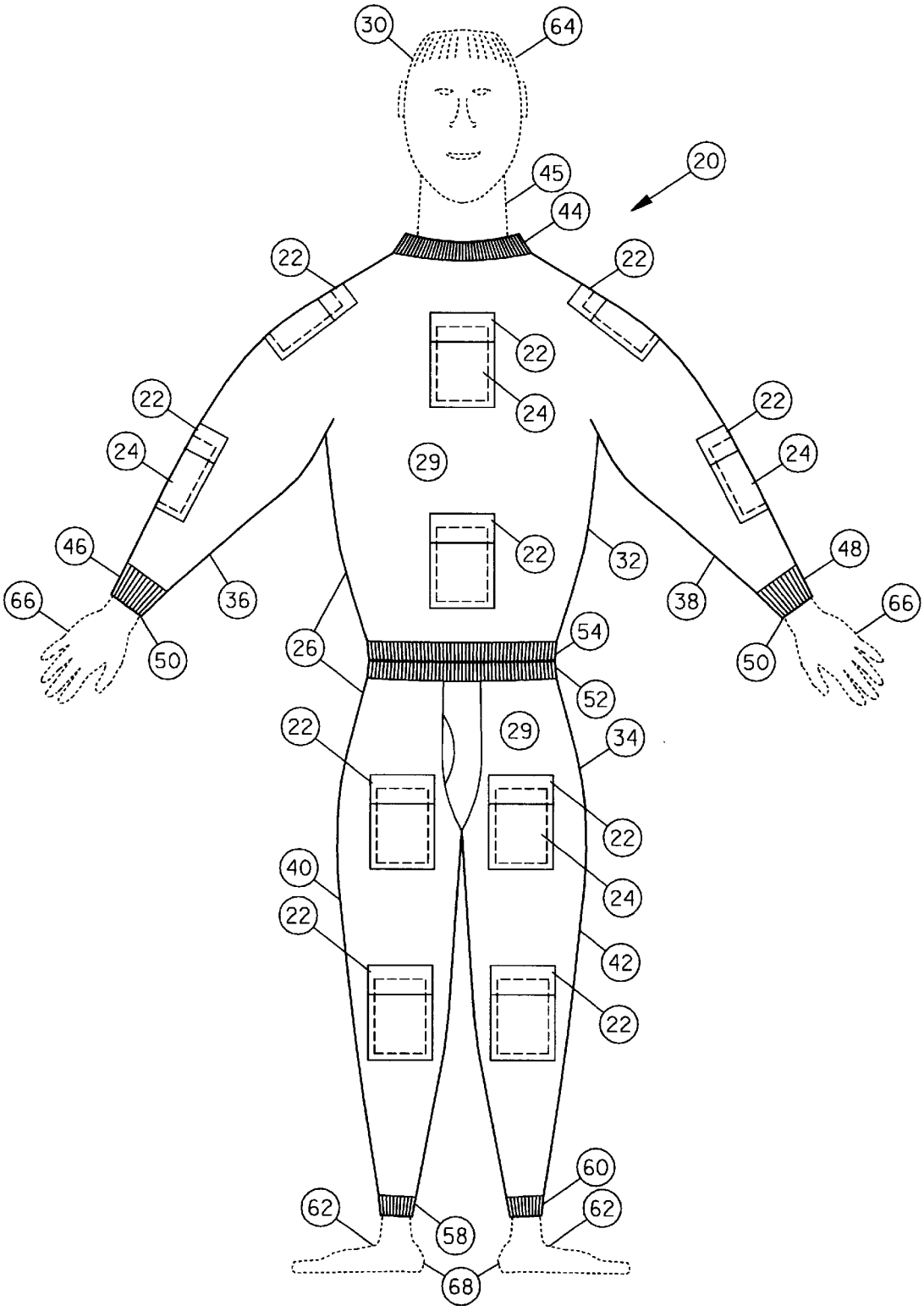
FIG. 2 is a front elevation exploded view of the article of clothing of FIG. 1.
Figure 3:
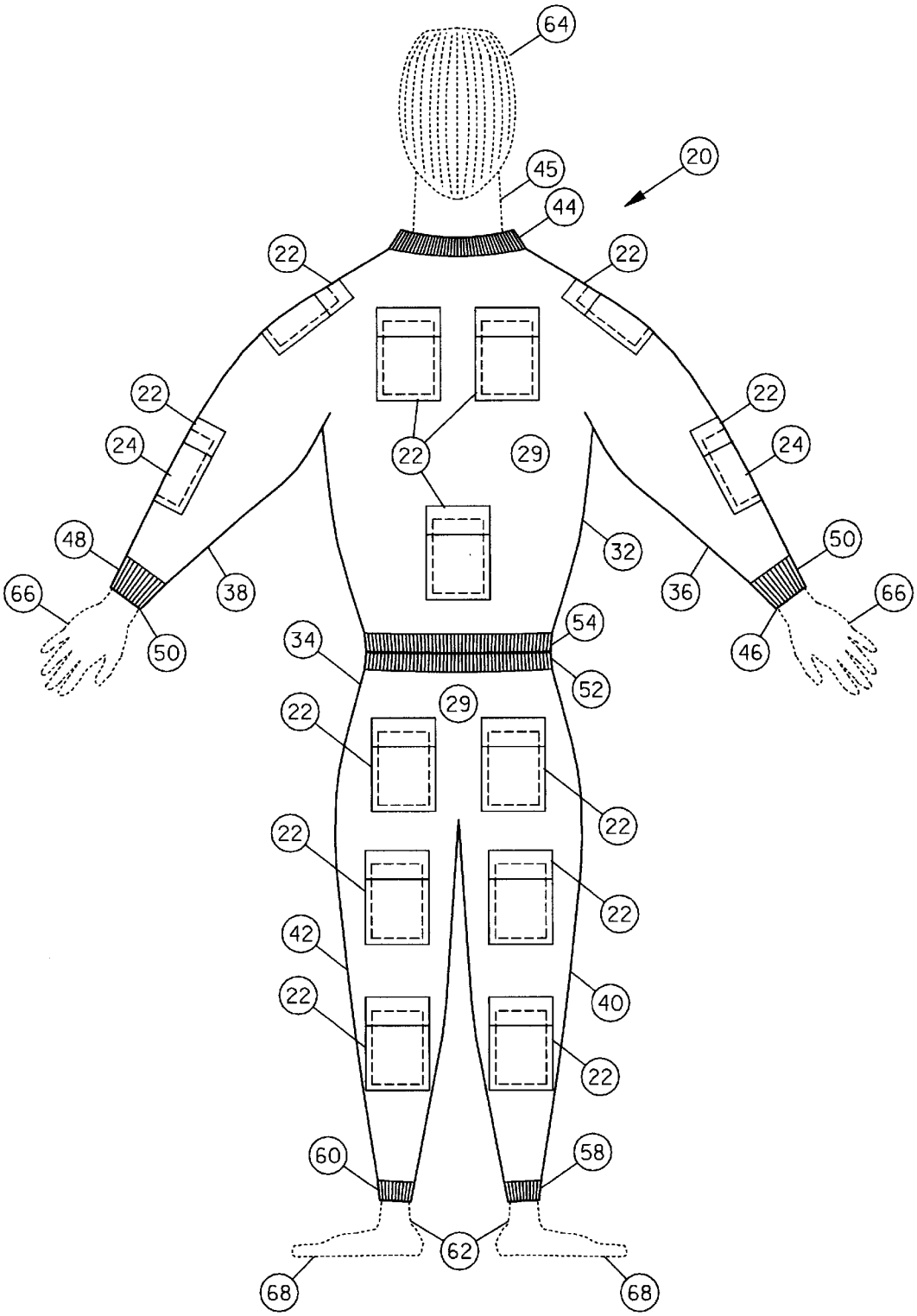
FIG. 3 is a rear elevation exploded view of the article of clothing of FIG. 1.

In the first embodiment, as shown in FIGS. 1–3, the upper torso component 32 and the lower torso component 34 are preferably separate pieces. Preferably pockets 22 are disposed on the arm-receiving portions 36, 38 near to the user's upper arm and forearm, with two pockets on each arm-receiving portion 36, 38. Two pockets are disposed on the front of the upper torso component 32, with the pockets located near the chest and upper abdomen of the user. Three pockets are disposed on the back of the upper torso component 32, with two of the pockets disposed near the upper back area of the user and the remaining pocket near the lower back region of the user. Four pockets are preferably disposed on the front of the lower torso component 34 with two pockets for each leg-receiving portion 40, 42, with one of the pockets near the upper leg and the other pocket near the shin of the user 30. Six pockets are preferably disposed on the back of the lower torso component 34 with a pocket disposed near each of the user's buttocks and two pockets positioned on each of the leg-receiving portions 40, 42, with one pocket near the back of the user's upper leg and the other pocket positioned near the back of the user's shin. Preferably the pockets 22 are made of the same fabric as the torso enveloping portion 26 and are of the envelope pocket style of construction previously described. The preferred fabric for use in this embodiment is any fabric that is breathable, stretchable, and can withstand the heat of the packet and is a breathable material with the ribbing usually elastic (possibly Velcro™) portions of a fabric.

In another aspect of the first embodiment best shown in FIGS. 1–3, wherein like numerals indicate like elements, the upper torso component 32 and the lower torso component 34 are joined together. This aspect of the present invention is referred to as the "Union Suit" underwear design. Where the article of clothing is fabricated in a unitary fashion, waist conforming portions 52, 54 is a single portion and is made of any typical waste band on the market today. The Union Suit does not need to cling to the waist. Cling could be done by belt or elastic or even drawstring. Pockets would be as FIG. 1–6.

The Union Suit aspect is like the longjohn aspect of the first embodiment in all other aspects, having the same preferred fabric for the torso enveloping portions, the same preferred ribbing fabrics for the ribbing portions, and the same commercially available brand of preferred thermal packet(s). The preferred fabric being a cotton-poly blend or cotton or polyester. There are no differences in the functions of longjohn and the Union Suit.

The torso enveloping portion 26, of the present invention is fabricated of a single or multiple layer of fabric 35, with the fabric having a stretchability sufficient to permit the article of clothing to conform to the body of the user, such that the respective inner wall 29, of the respective pocket 22, is in direct contact with the body of the user or the underwear, e.g. underpants, undershirt, and/or bra of the user. The fabric 35 is flexible, breathable and stretchable.

The fabric is both a moisture transmitting and a heat transmitting material to promote exchange of moisture from the body through the fabric and transmission of heat from the thermal packet through the fabric to warm the body of the user. Suitable fabrics include, but are not limited to, cotton knits, polyester, cotton, sweatsuit fleece, polypropylene knits, Gortex fabrics, LIFA fabrics, polartec™, spandex™, and others available on the market.

Each of the aforementioned fabrics 35 is flexible such that when stretched from a relaxed state to a stretched state, each fabric is able to recover and maintain its shape around the user's body surface. This stretchability enables the fabric to stretch sufficiently to conform to the body of the user.

Likewise each of these fabrics 35 have the property of being able to transmit moisture from the body of the user.

In addition each of these fabrics 35 is able to transmit heat from a thermal packet 24 source external to the user's body 30 through the fabric 35 to the user's body 30.

Preferably the pockets 22 are made of the same fabric as the torso enveloping portion 26 and are of the envelope pocket style of construction previously described for the first embodiment.

As is best shown in FIGS. 1–6, a kit of the present invention is disclosed. The kit comprises one of the articles of clothing 20 as previously described herein this application, in any one of the embodiments of the present invention and a plurality of commercially available thermal packets 24. The article of clothing 20 is a longjohn article of clothing, a sweatsuit, ski wear, or a Union Suit article of clothing as disclosed in the first embodiment. The number of commercially available thermal packets 24 preferably corresponds to the number of pockets on the article of clothing so that there is at least one thermal packet 24 available for each pocket on the article of clothing.

In the present invention there are preferably a plurality of pockets disclosed on each embodiment 20 thus the kit contains at least a plurality of thermal packets. This permits placement of one thermal packet 24 per pocket 22. Alternatively a greater number of thermal packets 24 may be included to allow for spares or to allow for the placement of multiple packets 24 per pocket 22 in the article of clothing 20. As has been previously discussed, each article of clothing 20 comprises a respective torso enveloping portion 26 having a respective upper torso component 32 and a respective lower torso component 34. The upper torso component 32 includes respective arm-receiving portions 36, 38. The lower torso component 34 has respective leg-receiving portions 40, 42. The respective torso enveloping potion 26 suitably conforms to the body of the user when the respective article of clothing 20 is worn by a user 30. A plurality of pockets 22 is affixed to the respective article of clothing 20. Each of the pockets 22 has a respective inner wall 70 integral with the respective torso enveloping portion 26, and a respective outer wall 72.

The kit includes a plurality of thermal packets 24 previously disclosed in this application. As has been previously described in this application, the thermal packets 24 are used to effect a heat transfer between each of the thermal packets 24 and the body of a user 30 of the article of clothing 20. Each of the pockets 22 is adapted to receive one or more of the thermal packets 24. When a thermal packet 24 is placed into a pocket 22 for use to effect a thermal change, the respective inner wall 70 and the respective outer wall 72 of the pocket are in direct contact with the thermal packet 24.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A thermal garment with pockets in combination with thermal packets that are placed in one or more pockets; said thermal garment and said thermal packet combination comprising:

a plurality of thermal packets;

a thermal garment including a torso enveloping portion having an upper torso component and a lower torso component;

said upper torso component including arm receiving portions;

said lower torso component including leg receiving portions;

said torso enveloping portion constructed so as to conform to the body of the user; said thermal garment having a plurality of pockets affixed thereto and disposed upon said upper and lower torso components including said arm-receiving and said leg-receiving portions;

each said pocket having an inner wall integral with said torso enveloping portion and an outer wall;

said pocket being sized and shaped to receive one of said thermal packets for effecting a heat transfer between the packet and the body of the user;

said inner wall and said outer wall of said pocket is in direct contact with one of said thermal packets.

2. The thermal garment of claim 1 wherein said thermal packets are disposable.

3. The thermal garment of claim 1 wherein said thermal packets are reusable.

4. The thermal garment of claim 1, wherein said upper component and said lower torso component are separate pieces.

5. The thermal garment of claim 1, wherein said upper torso component and said lower torso component are joined together.

6.The thermal garment of claim 1, wherein said torso enveloping portion is a single layer of fabric, said fabric having a stretchability sufficient to permit the article of clothing to conform to the body of the user, wherein said interior wall of said pocket is indirect contact with the body of the user.

* * * * *